US010315731B2

(12) United States Patent
Erlendsson

(10) Patent No.: US 10,315,731 B2
(45) Date of Patent: Jun. 11, 2019

(54) LINE FOR A SIGNAL BUOY AND METHODS FOR SUBMERGED OBJECT RETRIEVAL AND MONITORING

(71) Applicant: Hampidjan, hf, Reykjavik (IS)

(72) Inventor: Hjortur Erlendsson, Kopavogur (IS)

(73) Assignee: Hampidjan, hf, Reykjavik (IE)

( * ) Notice: Subject to any disclaimer, the term of this patent is extended or adjusted under 35 U.S.C. 154(b) by 0 days.

(21) Appl. No.: 15/506,703

(22) PCT Filed: Aug. 25, 2015

(86) PCT No.: PCT/IS2015/050014

§ 371 (c)(1),
(2) Date: Feb. 24, 2017

(87) PCT Pub. No.: WO2016/030914

PCT Pub. Date: Mar. 3, 2016

(65) Prior Publication Data

US 2018/0222556 A1 Aug. 9, 2018

(51) Int. Cl.
*B63B 22/06* (2006.01)
*B63B 21/22* (2006.01)

(52) U.S. Cl.
CPC ..... *B63B 22/06* (2013.01); *B63B 21/22* (2013.01); *B63B 2021/225* (2013.01); *B63B 2205/02* (2013.01)

(58) Field of Classification Search
CPC ..... B63B 21/22; B63B 22/06
See application file for complete search history.

(56) References Cited

U.S. PATENT DOCUMENTS

| | | | | |
|---|---|---|---|---|
| 5,007,029 | A | 4/1991 | Scott | |
| 5,766,049 | A | 6/1998 | Letourneau | |
| 6,112,634 | A * | 9/2000 | Head | B60R 21/235 280/728.1 |
| 6,540,186 | B1 * | 4/2003 | Fischer | B64D 17/40 248/205.2 |
| 2012/0241545 | A1 * | 9/2012 | Borntrager | B60P 7/0846 242/395 |

FOREIGN PATENT DOCUMENTS

| | | |
|---|---|---|
| CN | 102870140 | 1/2013 |
| FR | 2109096 | 5/1972 |
| WO | WO 2011/098901 | 8/2011 |

OTHER PUBLICATIONS

US 2009/269,709, George Fowler, et al., Published Oct. 29, 2009.

* cited by examiner

*Primary Examiner* — Stephen P Avila
(74) *Attorney, Agent, or Firm* — Donald E. Schreiber

(57) ABSTRACT

A signal buoy (1) for retrieval of submerged objects, the signal buoy line's cross section has an aspect ratio greater than two and two tenths to one and preferably greater than four to one. In some aspect the signal buoy line includes conductors so as to permit communicating with submerged objects. In other aspects, the present disclosure teaches a combination of a signal buoy and a buoyant fiber mooring rope storage structure for storing submerged in a body of water and above a seabed or other bottom of the body of water a fiber mooring rope for future retrieval.

11 Claims, 3 Drawing Sheets

LINE FOR A SIGNAL BUOY AND METHODS FOR SUBMERGED OBJECT RETRIEVAL AND MONITORING

BACKGROUND OF THE DISCLOSURE

Field of the Disclosure:

The present disclosure generally relates to the field of retrieval of objects submerged in a body of water including objects positioned at the bottom of a body of water, as is important in the field of Anchor Handling, and more particularly to the field of pre-laid anchor systems, and yet more particularly to the field of pre-laid anchor systems for use in exploration drilling of fossil fuels, and yet even more particularly to the field of pre-laid anchor systems for use in exploration drilling of fossil fuels where fiber ropes are used in long spans in substitution of long spans of chain and steel wire.

Background Information

Anchor handling, especially in winter, can be time-consuming and therefore costly. The operations often have to wait for a suitable weather window. The probability of finding a weather window to moor a rig to a pre-laid anchor system is about sixty percent greater than the probability to find a weather window to anchor the rig as it arrives. Delays and operational downtime associated with setting a rig's anchor system as a rig arrives in place can run into millions of dollars per rig set. In addition to the economic costs, anchor handling is one of the most dangerous operations during exploration drilling. The worse the weather conditions, the greater the costs and the greater the danger.

Thus, it has become important that the anchor system for a rig is pre-laid during safe weather conditions so that when a rig is ready to be moved into place the anchor system for the rig is already laid in place and ready for connection to the rig.

Faced with increasingly deeper installations, rig mooring lines in most new drilling sites are mainly formed with fiber rope for the reduced weight afforded by the fiber rope in comparison to chain or steel wire. The lesser the weight of the mooring lines the resultantly less floatation needed to suspend the mooring lines, permitting more economical rig constructions. Problematic to pre-laying anchor systems that mainly use fiber rope is that fiber ropes are easily damaged from contact with submerged obstacles, including other mooring lines and existing and abandoned infrastructure.

In attempt to solve these problems, it has become state of the art to pre-lay all portions of a rig's anchoring system with the exception that the fiber rope portion of the anchoring system is stored in a container that is stored at the seabed, especially in a large fabric bag or other container that is stored on the ocean or sea bottom. The fiber rope portion of the anchoring system is then retrieved just prior to connection to the rig.

Published PCT application having publication number WO2011102730, titled "IMPROVED DEVICE AND METHOD FOR FORMING AN ANCHOR SPREAD" teaches the present state of the art and trend in the industry for pre-laying rig anchor systems using fiber rope mooring lines. As taught in this publication, anchors are put out in advance; each of the anchors is connected to a fiber rope that is wrapped in a special way and stored in a "bag" or other container on the seabed. In addition, a signal buoy, such as a signal buoy know as a "Spin Buoy" can be used to lighten the connection with the fiber rope to the signal buoy. When at a later date the rig is in place at the location, a vessel can "call on" the signal buoys using coded sound waves, such as may be transmitted from an ROV. The signal buoys then rise to the surface while trailing behind each signal buoy a signal buoy line that ultimately connects to the much stronger fiber rope mooring line. The vessels can then collect the signal buoys, haul in the signal boy lines and thus retrieve ends of the fiber rope mooring lines, and at the retrieved end connect the fiber rope mooring lines with the rig's chains.

Recent state of the art attempts to store a fiber rope near the seabed for later retrieval include storing the fiber rope by winding it both upon as well as external a buoyant structure that is essentially a buoyant spool, spindle or cylinder, with one end of the fiber rope attached to the buoyant spool, spindle or cylinder (hereinafter also referred to as a "buoyant spool") and with the other end of the fiber rope, that is the last part of the fiber rope to be wound upon the buoyant spool, being attached to a chain that serves as an anchor chain that attaches to an anchor, the anchor thereby holding the end of the fiber rope to the sea bed. The buoyant spool is also fixed to the seabed by means of also being connected to, for example, the anchor chain, by means of a trigger that can be remotely activated by, for example, a coded acoustic signal. Upon activation, the trigger releases, and the buoyant spool ascends to the surface. The natural reaction of the upward ascent force of the buoyant spool, countered by that downward restraining force of that end of the fiber rope that is anchored to the seabed is to cause the buoyant spool to rotate about its long axis as it ascends, thereby paying out the fiber rope wound upon the cylinder. This rotation, induced during paying out of the signal buoy line for reasons taught supra, is known as "spinning". The present state of the art for such a spool, spindle or cylinder is known as the "Spin Buoy" and is promoted by Viking Moorings. In the present state of the art and current trend of the industry the rope coiled about a portion of the generally cylindrical signal buoy and/or fiber rope storage buoy (i.e. the buoyant generally cylindrically shaped spool with flanged ends, and e.g. a Spin Buoy), is especially a braided rope having a cross section that has an aspect ratio that preferably is one to one, and is either one to one, or less than one and one half to one. It is considered important that the fiber ropes cross section be as close to one to one as possible in order to preclude tangles and backlashes during payout while the buoy is spinning.

A result of the spinning is that Magnus Effect forces are caused by the rotation of the buoyant cylindrically shaped spool during its ascent through the water, and generate forces largely normalized relative to a straight line directed from the anchor point of the buoyant spool directly upwards against gravity toward the surface of the body of water.

In addition to the spinning, the downward vector acting upon the buoyant spool that is resulting from the downward pull of the fiber rope stored upon and being unwound from the buoyant spool is constantly varying it's point of origination on the spool, spindle or cylinder during its ascent to the surface due to the fact that as the fiber rope unwinds, it is continually travelling across the long dimension of that portion of the buoyant spool upon which it is spooled, thereby changing what point upon the axis of the buoyant spool originates the downward force vector resulting of the fact that the fiber rope is anchored to the bottom or to a submerged object at one of its ends and is connected to the buoy at another of its ends. As a result, the buoyant spool is constantly varying its orientation relative to gravity during it ascent through the water and to the surface.

Problematically, this constant variation of the orientation relative to gravity, in combination with the generated Magnus Effect forces, causes the buoyant spool to be subject to a great variety of fluxing lateral forces during it's ascent to the surface. The result of the Magnus Effect's horizontal forces is to cause the rotating buoyant cylindrically shaped spool to deviate from what would be a straight line ascent to the surface, and when combined with the fact that the buoyant spool is constantly varying its own orientation relative to gravity, the result of these combined phenomenon is that this type of signal buoy is constantly moving laterally in both the Y and Z directions during its ascent. Consequently, rather than breaching the surface at a certain location, these types of signal buoys are breaching at unexpected locations. Because much kinetic energy is present in the breaching signal buoy, which forces can easily kill a person, the unpredictable location of the buoy's breach presents a danger to crews' safety and lives.

However, "Spin Buoys" continue to be used in the industry, both as "Signal Buoys" and also as storage buoys for retrieval of mooring lines, despite the danger to crews, because winding a fiber rope on the external and generally cylindrical portion of a buoyant structure that is later called upon and remotely triggered or released so it can ascend to the surface from at or near a seabed is considered by the industry to be the most reliable way to store and subsequently unwind and/or pay out without tangles and backlashes a fiber rope upon a structure that is ultimately called upon to ascend to the surface from a previous location at or near a seabed.

Thus, it can readily be appreciated that a need continues to exist in the industry for a signal buoy or fiber rope storage buoy that breaches the surface in a reduced region of the surface so as to reduce the total potential area of its breach at the water's surface, thus increasing predictability of the signal buoys' breach location, thereby reducing danger to crews.

Thus, it also can readily be appreciated that a long felt need continues to exist in the industry for a solution to the problem of storing the fiber rope portion of a pre-laid anchoring system where the fiber rope portion of the pre-laid anchoring system can be safely retrieved.

None of the known art has proposed a solution to the above stated long felt needs of industry that is same as the solution taught in the present disclosure.

Objects of the Present Disclosure:

It is an object of the present disclosure to provide for a signal buoy that breaches the surface in a reduced region of the surface so as to reduce the total potential area of its breach at the water's surface, thus increasing predictability of the signal buoys' breach location, thereby reducing danger to crews.

It is another object of the present disclosure to provide for a signal buoy that ascends to the surface without spinning, or with minimal spinning, so as to increase the predictability of the signal buoys' breach location at the surface, thereby reducing danger to crews.

It is yet another object of the present disclosure to provide for a signal buoy that ascends to the surface without spinning, or with minimal spinning, so as to increase the predictability of the signal buoys' breach location at the surface, thereby reducing danger to crews, while concurrently ascending to the surface without incurring backlashes and/or tangles to its signal buoy line during paying out of the signal buoy line.

It is yet another object of the present disclosure to provide for a signal buoy that permits monitoring of and communication with submerged objects while simultaneously permitting accomplishing the stated goals of the present disclosure.

DEFINITIONS

For the purposes of the present disclosure, the term "signal buoy" and like terms shall mean a buoyant object that is capable of storing a line, such as but not limited to a fiber rope or other, and that is capable of being attached to a submerged object and/or attached to a bottom of a body of water and remaining submerged in a body of water for a predetermined period of time such as weeks or months, or greater, and later called upon from a remote location, the action of calling upon the signal buoy causing the signal buoy to be released from whatever object it is attached to that is holding it below the surface of the body of water, the action of being released causing the buoyancy of the signal buoy to cause it to ascend to the surface of the body of water while deploying a signal buoy line stored with the signal buoy, said signal buoy line remained attached to a submerged object and/or attached to the bottom of a body of water.

Brief Description of the Present Disclosure

In a presently preferred embodiment of the present disclosure the problems noted above in relation to the danger posed to crews due to the large region of breach at the water's surface of known signal buoys and/or buoyant fiber mooring rope storage buoys are solved in large part by use of a signal buoy that employs for its signal buoy line a line having an aspect ratio for its cross section, taken across the long dimension of the signal buoy line, as is understood in the industry to be where the cross section of a line is taken, where such cross section has an aspect ratio that is greater than two and two to one (i.e. greater than 2.1:1), and more preferably is greater than four to one, and yet more preferably is greater than six to one, and yet more preferably is greater than eight to one, and yet more preferably is greater than eleven to one, and even yet more preferably is greater than one hundred forty to two, and yet more preferably is exactly or about one hundred forty to three, and may be an even greater aspect ratio.

In the presently preferred embodiment the signal buoy line has an aspect ratio for its cross section that is one hundred forty to three (140:3), and the signal buoy line is a flat strap. The signal buoy line is packed in carefully arranged folded layers within a cavity internal a buoyant body, and is mainly not wound or coiled as taught in the known art for known signal buoys. The buoyant body subsequently is fixed to another object that is an object that is submerged in a body of water, such as an anchor, or an anchor chain, or a scientific instrument, or the end of a mooring rope, or any item or object the retrieval of which or monitoring of at a later date may be desired.

At a later date, that can be any time after the original fixing of the signal buoy to the submerged object, the signal buoy is called upon using, for example, a coded acoustic signal, and is released from the object to which it is fixed to by means of, for example, an acoustic trigger, as is currently the trend in the industry for remotely calling upon a signal buoy and thereby causing its release from a submerged object to which it had been fixed by means of an acoustic trigger. The signal buoy line remains fixed to the submerged object or to another submerged object. As a result of its having been released from the submerged object to which it had previously been fixed, the signal buoy rises to the surface. As a result of the signal buoy line of the present disclosure being a flattened line of the presently disclosed cross sectional aspect ratios, and as a result of the signal buoy's flattened line of the present disclosure being stored in folded layers having been carefully packed within a cavity within the signal buoy of the present disclosure, the signal buoy line of the present disclosure is deployed without causing spinning.

In order to prevent kinks, backlashes and tangles to the flattened signal buoy line, the flattened signal buoy line of the present disclosure is carefully packed in folded layers that require a predetermined tension in order to permit payout of the signal buoy line. The predetermined tension may be created by a pressure plate that causes compression of the mass of the flattened folded signal buoy line against an internal wall of the cavity within the signal buoy that is an internal wall where is situated an aperture from which exits and pays out the flattened signal buoy line.

The pressure plate can be a spring loaded plate that is maintained in a plane parallel to the flat folded layers of the flattened signal buoy line (and more perpendicular to the direction of the signal buoy line's payout direction from the signal buoy than it is parallel to such direction) by means of springs attached to the back side of the pressure plate, that is the side of the pressure plate that is not in contact with the signal buoy line, where such springs apply pressure to the pressure plate at various locations along the pressure plate so that the pressure plate maintains the desired orientation and continues to apply pressure to the folded layers of the flattened signal buoy line. Alternatively, the pressure plate may be of sufficient mass and weight so as to cause the needed pressure, and the signal buoy is constructed so as to maintain an upright orientation so that the pressure plate maintains the desired pressure onto the folded flattened signal buoy line of the present disclosure. The pressure plate has a slit formed into its center to permit passage of the signal buoy line that is, as taught, in the form of a webbing strap having the taught aspect ratios for its cross section. While in less preferred embodiments the folded layers may not be in a flat form, such is not presently preferred. In general, the pressure plate compresses the folded layers of the signal buoy line against a wall of the internal cavity, no matter whether flat folded layers are used, or curved folded layers, or other.

As a result of the presently preferred construction of a signal buoy of the present disclosure, the signal buoy of the present disclosure breaches the water's surface within a more predictable location. Particularly, the potential area of breach at the water's surface at which breaches the signal buoy of the present disclosure is a surface area that is lesser than the surface area at the water's surface at which known signal buoys breach.

Such construction of a signal buoy, such construction of a signal buoy line, and such combination of a signal buoy and a signal buoy line as taught herein, including a signal buoy line having the above stated aspect ratios for the line's cross section as taught above for the signal buoy line of the present disclosure, being contrary to the state to the art and against the trend in the industry, and the storage of the signal buoy line within the signal buoy as opposed to wound about the exterior of the signal buoy, which also is contrary to the state of the art and believed to result in tangles of a signal buoy line, nonetheless exhibit an unexpected result of permitting tangle free deployment of the signal buoy line of the present disclosure while simultaneously causing the location of the signal buoys breach at the water's surface to be within a region that is considered by crews to be a small enough region to permit safe and predictable use of the signal buoy of the present disclosure, thereby resolving a long felt need in the industry.

In using a preferred embodiment of the signal buoy of the present disclosure a signal buoy of the present disclosure is combined with either a non-buoyant or with a buoyant fiber mooring rope storage structure, and where the signal buoy of the present disclosure most preferably is situated above the top of the fiber mooring rope storage container by virtue of the fact that the present disclosure's signal buoy it is attached to an end of the fiber mooring rope that is intended to be connected with a rig's chains (i.e. the chains tensed by the rig's winches).

In order to preclude accidental contact with trawling gear, in another embodiment of the present disclosure, the present disclosure's signal buoy has attached to itself by means of a line that is much less resilient to breakage than the signal buoy line a flag buoy formed of a highly acoustically detectable material and that is positioned an elevation above the sea bed that is located at least three meters above the sea bed, with an elevation of at least five meters being more preferred, with an elevation of at least ten meters being yet more preferred, with greater elevations being highly useful. In such embodiment of the present disclosure, accidental contact with trawling gear of the present disclosure's signal buoy, as well as with any portions of a pre laid anchoring system intended to be retrieved by calling upon the present disclosure's signal buoy, and apparatus of the present disclosure is either eliminated or virtually eliminated, meaning is reduced to such an infrequency as to constitute a negligible and acceptable damage cost.

The above stated advantages of the present disclosure, as well as other advantages of the present disclosure, are likely to become readily apparent to those skilled in the art from the following detailed description of a preferred embodiment of the present disclosure, that is by no means intended to be limiting, including when considered in light of the accompanying drawings and the following detailed description of the preferred embodiments, in which:

DETAILED DESCRIPTION OF THE PREFERRED EMBODIMENT

Figure 1:
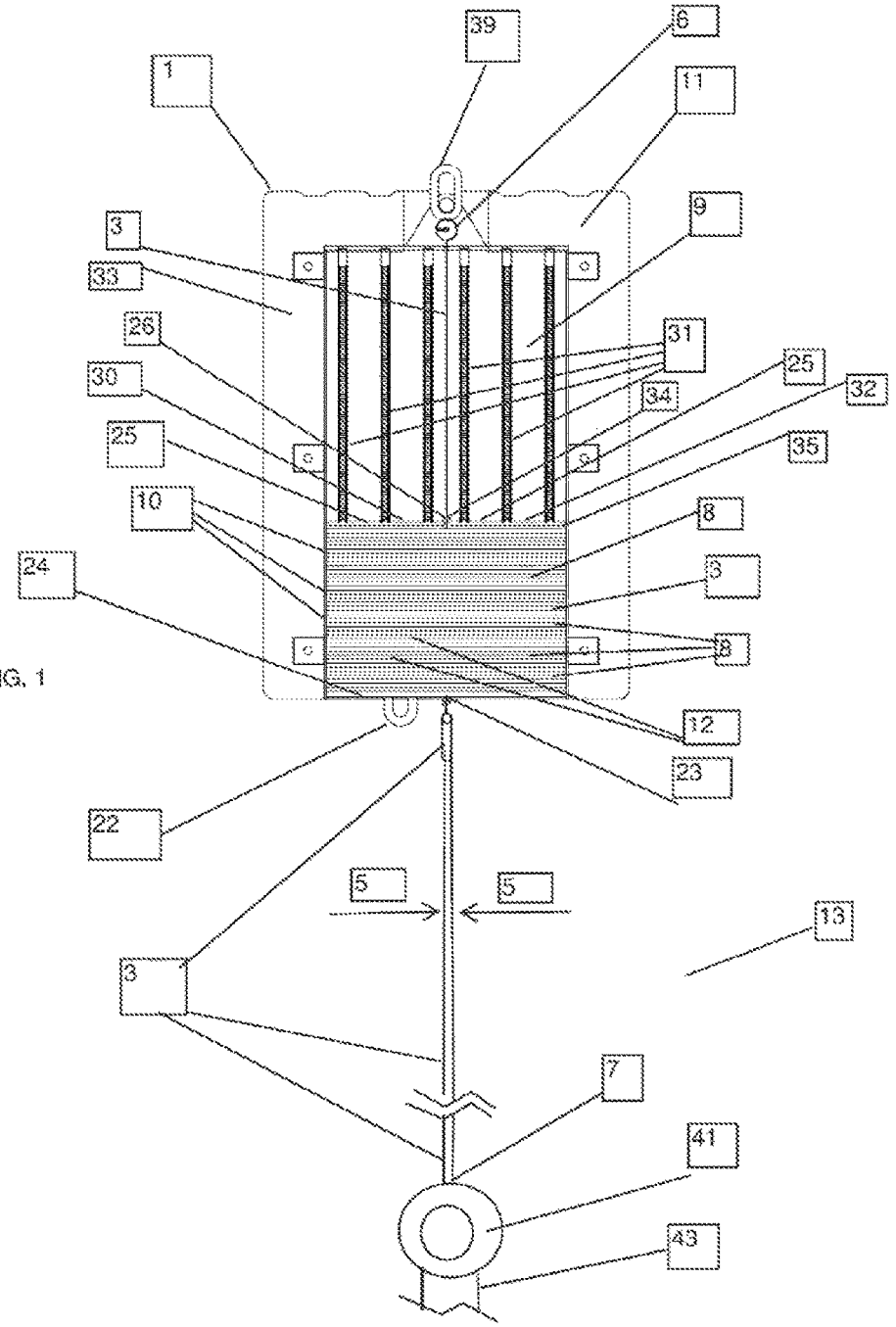
FIG. 1 is a side plan cross sectional view of the signal buoy and signal buoy line apparatuses of the present disclosure where the signal buoy is in the process of ascending to the surface of a body of water and the signal buoy's signal buoy line is partly deployed.
Figure 2:
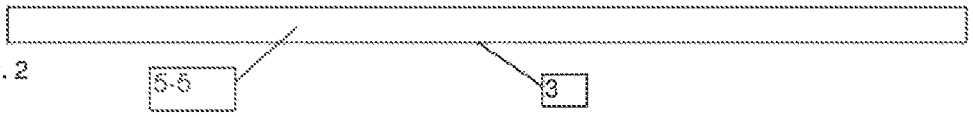
FIG. 2 is a cross sectional view of the signal buoy line of FIG. 1.

In reference to FIG. 1:

Signal buoy (1) has signal buoy line (3) where signal buoy line (3) has an aspect ratio for its cross section (see FIG. 2) and indicated by section line (5-5) taken across the long dimension of the signal buoy line (3) of FIG. 1, where such cross section has an aspect ratio that is greater than two point two to one, and more preferably is greater than four to one, and yet more preferably is greater than six to one, and yet more preferably is greater than eight to one, and yet more preferably is greater than ten to one, and even yet more preferably is greater than one hundred forty to two, and yet more preferably is exactly or about one hundred forty to three, and may be an even greater aspect ratio. While the cross sectional form shown in FIG. 2 is a rectangle, it is understood that the cross sectional form may vary, including for example a rectangle with rounded corners and/or rounded short ends and corners.

In the presently preferred embodiment the signal buoy line has an aspect ratio for its cross section (5-5) that is one hundred forty to three, and is a flat strap. For example, a flat strap having a width of one hundred forty millimeters and a height of three millimeters. The signal buoy line is fixed to the signal buoy at one end of the signal buoy line, such as at a point indicated by reference numeral (6), and is fixed at its other end (7) to an object submerged in body of water and/or capable of being submerged in a body of water. The signal buoy line (3) is packed in carefully arranged layers (8) by preferably being carefully folded into a stack (4) of layers (8) within a cavity (9) that preferably is internal a buoyant body (11) that comprises the signal buoy (1). The folded layers (8) include corners (10) where the flattened signal buoy line preferably bends back over itself at one hundred eighty degrees, and also includes between corner signal buoy line segments (12). When packed into the cavity (9), the between corner signal buoy line segments (12) form a stack of between corner signal buoy line segments (12), which comprises the folded layers (8) that comprises the stack (4) of layers (8) stored within the cavity (9). However, in less preferred embodiments, the cavity (9) may be replaced by a bracket or bracket type arrangement, or can be formed into another object that is attached to the buoyant body (11), or, in other less preferred embodiments, the cavity can be mainly internal the buoyant body (11). In other less preferred embodiments, the cavity (9) may be formed with perforated walls (not shown), all of which such constructions for the internal cavity are herein referred to as being "internal at least a portion of the buoyant body" or "internal at least a portion of the signal buoy".

Figure 3:
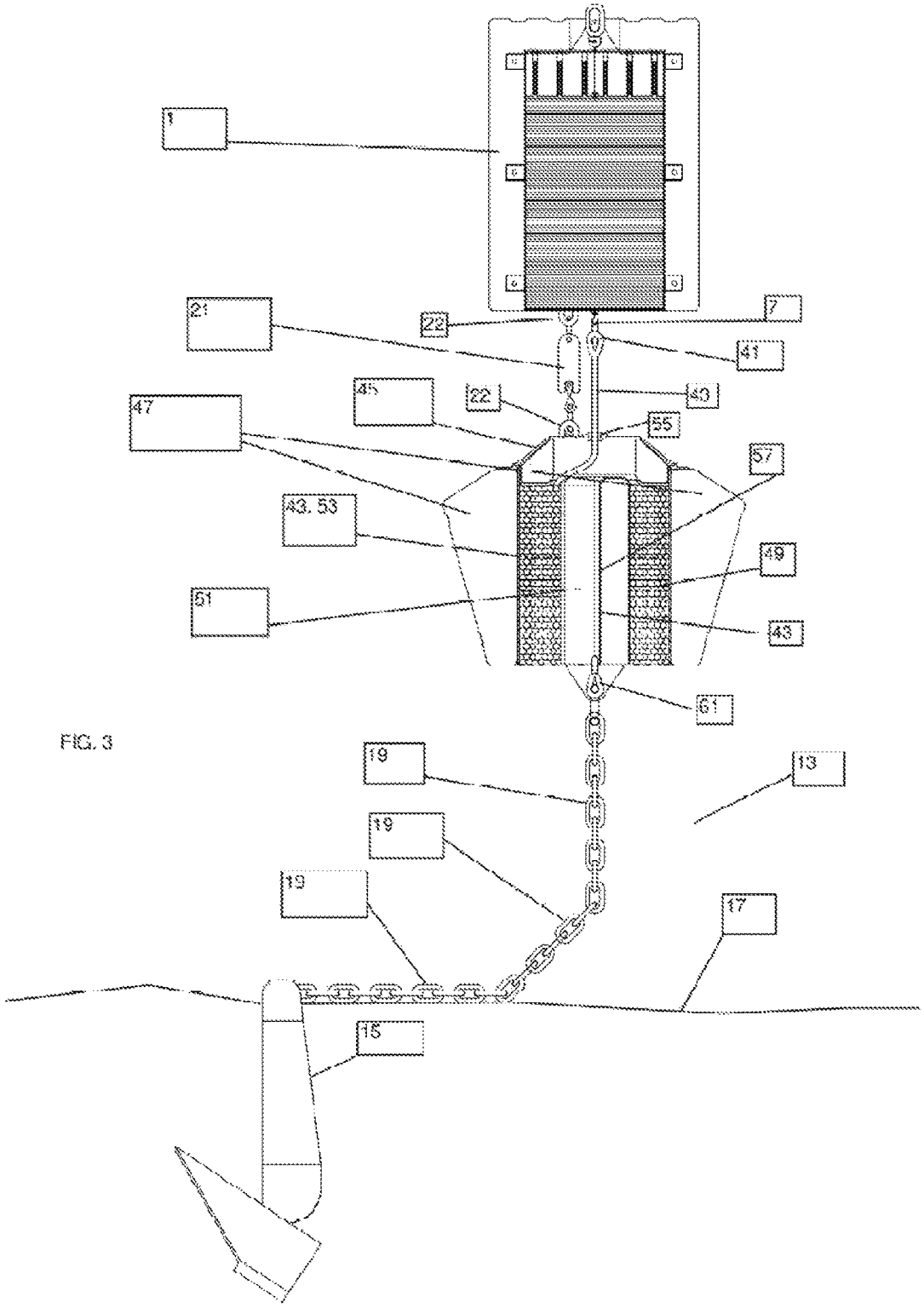
FIG. 3 is a side plan cross sectional view of a mooring rope container buoy apparatus of the present disclosure, where the fiber mooring rope is partly deployed.

In continuing reference to FIG. 1 and also in reference to FIG. 3:

The buoyant body subsequently is fixed to another object that is an object that is submerged in a body of water (13), where such object may be an anchor (15) that is embedded and/or partly embedded and that is capable of being embedded and/or partly embedded into the bed (17) at the bottom of the body of water, or that may be an anchor chain (19), or a scientific instrument, or the end of a mooring rope, or any item or object that the retrieval of which or monitoring of at a later date may be desired.

At a later date, that can be any time after the original fixing of the signal buoy to the submerged object, the signal buoy is called upon and is released from the object to which it is fixed to by means of, for example, an acoustic trigger (21, (see FIG. 3), where the acoustic trigger connects the signal buoy to the submerged object at, for example, connection rings (22). The signal buoy line remains fixed to the submerge object or to another submerged object. As a result of the signal buoy having been released from the submerged object to which it had previously been fixed, the signal buoy rises to the surface. As a result of the signal buoy rising to the surface and also as a result of the signal buoy line being stored within the signal buoy and simultaneously being connected at one end to at least one of the another objects submerged within the body of water and not rising to the surface simultaneous with the signal buoy's rising to the surface, the signal buoy line is pulled out of the signal buoy, through deployment aperture (23) that communicates the internal cavity (9) to the body of water.

As a consequence of the fact that signal buoy line of the present disclosure is a line having the presently disclosed cross sectional aspect ratios (also referred to herein either as a "flattened line" or as a line having a "high aspect ratio cross section"), and as a result of the signal buoy's high aspect ratio and preferably flattened line of the present disclosure being stored in folded layers (including "folds") having been carefully packed within the cavity within the signal buoy of the present disclosure, and due to the pressure maintained on folded layers of the signal buoy line during its deployment as taught in more detail below, the signal buoy line of the present disclosure is deployed without either causing spinning or requiring spinning of the signal buoy.

In order to prevent kinks, backlashes and tangles to the flattened signal buoy line, the flattened signal buoy line of the present disclosure is carefully packed in folded layers (8) that require a predetermined tension and/or minimum tension in order to permit payout of the signal buoy line. The predetermined tension may be created by a pressure plate (25) that causes compression of the stack (4) of layers (8) of the flattened folded signal buoy line against an internal wall (24) of the cavity (9) within the signal buoy that is an internal wall (24) where is situated the aperture (23) (aperture not shown) from which exits and pays out the signal buoy line, and where such aperture may be formed as a slit.

In addition, the pressure plate has a pressure plate slit (26) or other aperture that permits passage through the pressure plate of that portion of the signal buoy line that remains within the cavity (9) during and after payout of the signal buoy line (3). In such embodiment of the pressure plate, the width of the cross section of the signal buoy line may be slightly lesser than the internal width of the cavity (9) in which is stored the signal buoy line. However, and presently preferred, in other embodiments, the pressure plate may be divided into two portions, such as a pressure plate left side portion (30) and a pressure plate right side portion (32), that are not joined at their proximal ends so as to result in a pressure plate gap (34) situated between the two portions (30, 32), so that the portion of the signal buoy line that remains within the cavity (9) during and after payout of the signal buoy line (3) does not prevent movement of the pressure plate. In other embodiments, that end of the signal buoy line that is fixed to the signal buoy may be fixed to the pressure plate itself, such as at its center via a pair of slits formed at the center of the pressure plate about which the signal buoy is first wound and then sewn into an eye, thereby permitting movement of the pressure plate.

The pressure plate can be a spring loaded plate that is maintained in a plane parallel to the flat folded layers of the packed flattened signal buoy line (and more perpendicular to the direction of the signal buoy line's payout direction from the signal buoy than it is parallel to such direction) by means of springs (31) attached to the back side of the pressure plate, that is the side of the pressure plate that is not in contact with the signal buoy line, where such springs apply pressure to the pressure plate at various locations along the pressure plate so that the pressure plate maintains the desired orientation and continues to apply pressure to the folded layers of the flattened signal buoy line during payout of the signal buoy line, such payout of the signal buoy line causing reduction in the size of the packed mass of the folded layers and/or "fold" of the signal buoy line within the cavity (9). Alternatively, the pressure plate may be of sufficient mass and weight so as to cause the needed pressure upon the top side (35) of the packed mass (29) of the folded layers and/or "folded layers" of the stored signal buoy line of the present disclosure, during storage and deployment of the signal buoy line.

The present disclosure's signal buoy is constructed so as to maintain an upright orientation during deployment of the signal buoy line by having more buoyant mass (33) in the portion of the signal buoy distal the aperture (23) than proximal such aperture, with the buoyancy predetermined so that the signal buoy maintains a generally upright orientation during deployment of the signal buoy line. When the signal buoy breaches the water's surface, crews can pick up the signal buoy by for example passing a hook through eyelet or metal link (39) at situation at the top of the signal buoy.

After breaching the surface of the body of water, the signal buoy is then hauled aboard a vessel, its signal buoy line is subsequently secured, and if it is desired to bring to the surface whatever submerged object is attached to the end (7) of the signal buoy line, such as, for example, an end (41) of a fiber mooring rope (43), then the signal buoy line is subsequently retrieved so as to permit securing, for example, the end of the fiber mooring rope. However, in other applications, the signal buoy line may include conductors (not shown) that are ultimately connected to a submerged object. Communication with the submerged object is thereby permitted through the conductors. In this case, it may be desired to retrieve and/or send electrical energy and/or light waves, such as in the instance of fiber optic conductors, including but not limited to information signals, from the conductor to the submerged object prior to retrieval of the submerged object.

The signal buoy may be reused by repacking it with a new signal buoy line or by recycling the existing signal buoy line. That is, the signal buoy line is inspected for damage, and if not damaged, can be re-packed into the cavity (9) by first winding the deployed signal buoy line upon a winch and then transferring it over to a transport reel. The signal buoy line is then unwound from the transport reel and reinstalled into the cavity (9) in the stack (4) of layers (8).

EXAMPLES

1. A signal buoy (1) having a buoyant body and a signal buoy line (3), the signal buoy line having a cross section (5-5), the cross section having an aspect ratio, the signal buoy characterized by the fact that the signal buoy line's cross section has an aspect ratio greater than two and two tenths to one and preferably greater than four to one.
2. The signal buoy of example 1 where the signal buoy line's cross section has an aspect ratio greater than six to one.
3. The signal buoy of example 2 where the signal buoy line's cross section has an aspect ratio greater than eleven to one.
4. The signal buoy of example 3 where the signal buoy line's cross section has an aspect ratio greater than forty to one.
5. The signal buoy of any of examples 1 through 4 where the signal buoy is further characterized by the fact that its signal buoy line is stored in a stack (4) of layers (8).
6. The signal buoy of any of examples 1 through 5 where the signal buoy is further characterized by the fact that a pressure plate (25) is situated so as to apply pressure to the stack (4) of layers (8).
7. The signal buoy of any of examples 1 through 6 where the signal buoy line is formed as a flattened strap of webbing.
8. The signal buoy of any of examples 1 through 7 where the signal buoy line is further characterized by the fact that it includes conductors.
9. A method for repeated use of a signal buoy (1) having a signal buoy line (3), the method characterized by steps of:
   a) selecting to form a signal buoy line (3) from a line having a cross section (5-5) having an aspect ratio greater than six to one;
   b) causing release of the signal buoy from a location that is submerged in a body of water (13) thereby also causing pay out of the signal buoy line (3);
   c) retrieving the released signal buoy and the payed-out signal buoy line (3); and
   d) re-packing the signal buoy line (3) into a stack (4) of layers (8), and retaining the stack of layers with the signal buoy.
10. The method of example 9 further characterized by steps of selecting to re-pack the signal buoy line (3) into the stack (4) of layers (8) within a cavity (9) formed in the signal buoy.
11. A method for repeated use of a signal buoy (1) having a signal buoy line (3), the method characterized by steps of:
   a) selecting to form a signal buoy line (3) from a line having a cross section (5-5) having an aspect ratio greater than six to one;
   b) causing release of the signal buoy from a location that is submerged in a body of water (13) thereby also causing pay out of the signal buoy line (3);
   c) retrieving the released signal buoy and the payed-out signal buoy line (3);
   d) winding the signal buoy line (3) upon a winch;
   e) transferring the signal buoy line (3) from the winch over to a transport reel; and
   f) unwinding the signal buoy line (3) from the transport reel and re-packing the signal buoy line (3) into a stack (4) of layers (8), and retaining the stack of layers with the signal buoy.

The construction of a signal buoy of the present disclosure and the construction of a signal buoy line of the present disclosure, and the combination of the signal buoy of the present disclosure and the signal buoy line of the present disclosure, being contrary to the state to the art and against the trend in the industry, and the storage of the signal buoy line within a cavity as opposed to wound about the exterior of a buoyant body, which also is contrary to the state of the art, nonetheless exhibit an unexpected result of permitting tangle free deployment of the signal buoy line of the present disclosure while simultaneously causing the location of the signal buoys breach at the water's surface to be within a region that is considered by crews to be a small enough region to permit safe and predictable use of the signal buoy of the present disclosure. Particularly, the potential area of breach at the water's surface at which breaches the signal buoy of the present disclosure is a surface area that is lesser than the surface area at the water's surface at which known signal buoys breach, allowing crews to safely retrieve the signal buoy. Thus, objects of the present disclosure are accomplished and needs long felt in the industry are resolved.

Figure 4:
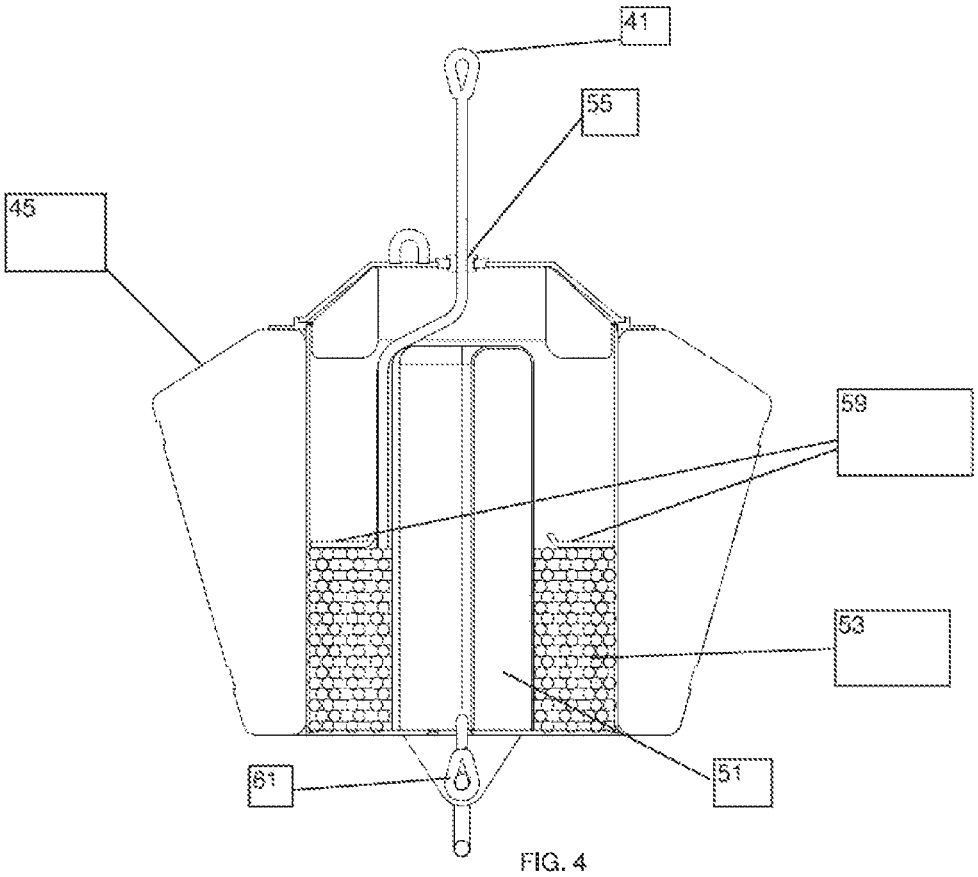
FIG. 4 is a side plan cross sectional view of an apparatus of the present disclosure formed by a combination of the signal buoy of the present disclosure and the mooring rope container buoy of the present disclosure, at rest above a seabed or above the bottom of another body of water, prior to release of the signal buoy and thus prior to the ascent of the signal buoy to the surface of the body of water.

In Further reference to FIG. 3 and FIG. 4:

In another preferred embodiment of the present disclosure the problems noted above in relation to the fiber rope mooring line portion of the pre laid anchoring system and apparatus of the present disclosure are solved by an apparatus that combines the buoyant signal buoy of the present disclosure with a buoyant fiber mooring rope storage structure (45) of the present disclosure, where such buoyant fiber mooring rope storage structure is positioned above the seabed and prevented from ascending to the surface by virtue of the fact that it is anchored to the seabed, such as by anchor (15) and anchor chain (19). The signal buoy most preferably is attached to the top of the buoyant fiber mooring rope storage container by both acoustic trigger (21) and also by virtue of the fact that end (7) of the signal buoy line (3) is attached to end (41) of the fiber mooring rope that is intended to be connected with a rig's chains (for example, chains tensed by the rig's winches).

The fiber mooring rope storage structure (45) of a pre laid anchoring system of the present disclosure also includes fiber mooring rope (43) having end (41) that is an end prepared for attachment to a rig's chains. The fiber mooring rope storage structure of the present disclosure is a buoyant body that is capable of positive buoyancy when full loaded with a fiber mooring rope as happens during storage of a fiber mooring rope submerged in a body of water at an elevation above the seabed or bottom of body of water that is taught herein. The fiber mooring rope storage structure includes buoyant portions (47), mooring rope storage cavity (49) within which is stored the majority of the fiber mooring rope during its storage period submerged in a body of water. The mooring rope storage cavity preferably includes a cylindrical body (51) situated centrally in the mooring rope storage cavity (49) and about which are wound layers (53) of the fiber mooring rope. The cylindrical body (51) situated centrally in the mooring rope storage cavity also includes a hollow passage (57) passing through the cylindrical body and through which is threaded a portion of the fiber mooring rope, so as to permit connecting fiber mooring rope end (41) prepared for connection to a rig's chains with fiber mooring rope end (61) that is connected to the anchor and/or anchor chain, in a tangle free fashion, without kinks that weaken a fiber mooring rope. The passage (57) preferably is oriented generally along the long and central axis of the cylindrical body (51). The cylindrical body may be replaced by another upright body, however, in the presently preferred embodiment, a cylindrical body is most preferred.

Referring to FIG. 4:

A weight plate (59) that is formed in the shape of a disk with an aperture centrally located in the weight plate is situated threaded upon the cylindrical body (51) that is centrally situated in the fiber mooring rope storage cavity, the weight plate being heavy enough to maintain the spooled and/or wound fiber mooring rope in a tangle free and backlash free state during pay out of the fiber mooring rope through aperture (55) situated at the top of the fiber mooring rope storage structure of the present disclosure.

The fiber mooring rope storage structure (45) of the pre laid anchoring system of the present disclosure is preferably situated at an elevation above the sea bed (17) that is at least one meter above the seabed, and more preferably that is greater than one meter above the seabed, and that may be up to several meters above the seabed, such as ten meters above the seabed, twenty meters above the seabed, or even more. This teaching of the present disclosure precludes accidental contact with trawling gear and also eliminates the entry into the fiber rope mooring line of ultra-fine sand particles and debris.

Upon calling upon the signal buoy of the present disclosure, such as by sending a coded acoustic signal to the acoustic trigger (21), the signaling buoy released from the fiber mooring rope storage structure of the present disclosure, ascends to the surface and breaches the surface in a region the surface area of which is considered sufficiently small to permit safe prediction of the signal buoy's breach location, the signal buoy is retrieved by crew, the signal buoy line is hauled in thereby hauling to the surface the fiber mooring rope end (41) prepared for anchoring to a rig's chains. The end (41) may then be anchored to a rigs chains with confidence that the fiber mooring rope is free from damage resultant of contact with trawling gear, ultra-fine sand and debris, or other objects.

Thus, objects of the present disclosure are attained by the teachings of the present disclosure.

EXAMPLES

12. An apparatus for storing submerged in a body of water (13) at least a portion of a fiber mooring rope (43) for retrieval at a time that is a time at least days later than a time of commencement of the storage submerged in the body of water of the at least a portion of the fiber mooring rope, the apparatus having at least a fiber mooring rope storage structure (45) and at least a signal buoy (1) having at least a signal buoy line (3), the apparatus characterized by the fact that the fiber mooring rope storage structure is provided with sufficient buoyancy to be buoyant at least when storing the at least a portion of fiber mooring rope, and, in combination with the signal buoy, both the at least a portion of the fiber mooring rope stored within the fiber mooring rope storage structure (45) as well as the signal buoy that connects to at least one end (41) of the fiber mooring rope are stored in a location that is both submerged in the body of water as well as elevated above a bed (17) forming a bottom (17) of the body of water.

13. A method for pre-laying at least a portion of a fiber mooring rope (43) submerged in a body of water (13) for retrieval at a date that is subsequent to a date the at least a portion of the fiber mooring rope is placed submerged in the body of water, the method comprising steps of:

a) forming a fiber mooring rope storage structure (43) with sufficient buoyancy so that the fiber mooring rope storage structure is buoyant when the at least a portion of the fiber mooring rope is retained by the fiber mooring rope storage structure and submerged in a body of water;

b) retaining the at least a portion of fiber mooring rope by the fiber mooring rope storage structure;

c) attaching an end (41) of the at least a portion of the fiber mooring rope to an end (7) of a signal buoy line attached to a signal buoy, and attaching the fiber mooring rope storage structure to an anchor (15) by a length of anchor chain (19);

c) submerging in a body of water the combination of the at least a portion of fiber mooring rope and the fiber mooring rope storage structure; the signal buoy and its signal buoy line; and the anchor, after having selected the buoyancy of the fiber mooring rope storage so as to float in the body of water above a bed (17) forming a bottom of the body of water the combination of the at least a portion of fiber mooring rope and the fiber mooring rope storage structure a distance predetermined by also selecting a predetermined length and weight in water for the length of anchor chain (19).

While the present disclosure has been described in terms of its presently preferred embodiments, others, most likely, having read the instant disclosure, shall suggest various alternatives and variations, which are intended to be encompassed by the present disclosure and the claims of the present disclosure.

Although the present disclosure has been described in terms of the presently preferred embodiment, it is to be understood that such disclosure is purely illustrative and is not to be interpreted as limiting. Consequently, without departing from the spirit and scope of the disclosure, various alterations, modifications, and/or alternative applications will, no doubt, be suggested to those skilled in the art after having read the preceding disclosure. Accordingly, it is intended that the following claims be interpreted as encompassing all alterations, modifications, or alternative applications as fall within the true spirit and scope of the disclosure including equivalents thereof. In effecting the preceding intent, the following claims shall:

1. not invoke paragraph 6 of 35 U.S.C. § 112 as it exists on the date of filing hereof unless the phrase "means for" appears expressly in the claim's text;

2. omit all elements, steps, or functions not expressly appearing therein unless the element, step or function is expressly described as "essential" or "critical;"

3. not be limited by any other aspect of the present disclosure which does not appear explicitly in the claim's text unless the element, step or function is expressly described as "essential" or "critical;" and 4. when including the transition word "comprises" or "comprising" or any variation thereof, encompass a non exclusive inclusion, such that a claim which encompasses a process, method, article, or apparatus that comprises a list of steps or elements includes not only those steps or elements but may include other steps or elements not expressly or inherently included in the claim's text.

The invention claimed is:

1. A signal buoy (1) adapted for deployment in a body of water, the signal buoy (1) being capable of:

A) being attached to a submerged object that is beneath a surface of the body of water;

B) remaining submerged in the body of water while attached to the submerged object for a predetermined period of time; and later C) being called upon from a remote location for freeing the signal buoy (1) from the submerged object; the signal buoy (1) comprising:

E) a buoyant body; and

F) a signal buoy line (3):

i. stored within the signal buoy (1) a first end of which is attached to the signal buoy (1);

ii. having cross section (5-5), the cross section having an aspect ratio, the aspect ratio exceeding four to one; and iii. a second end of which, distal from the first end, is attached to the submerged object;

whereby releasing the signal buoy (1) from the submerged object causes the signal buoy (1) to ascend to the surface of the body of water while deploying the signal buoy line (3).

2. The signal buoy of claim 1 where the signal buoy line's cross section has an aspect ratio greater than six to one.

3. The signal buoy of claim 2 where the signal buoy line's cross section has an aspect ratio greater than eleven to one.

4. The signal buoy of claim 3 where the signal buoy line's cross section has an aspect ratio greater than forty to one.

5. The signal buoy of any of claims 1 through 4 where the signal buoy is further characterized by the fact that its signal buoy line is stored in a stack (4) of layers (8).

6. The signal buoy of claim 5 where the signal buoy is further characterized by the fact that a pressure plate (25) is situated so as to apply pressure to the stack (4) of layers (8).

7. The signal buoy of claim 6 where the signal buoy line is formed as a flattened strap of webbing.

8. The signal buoy of claim 7 where the signal buoy line is further characterized by the fact that it includes conductors.

9. A method for repeated use of a signal buoy (1) having a signal buoy line (3), the signal buoy (1) being adapted for deployment in a body of water, the signal buoy (1) being capable of:

A) being attached to a submerged object that is beneath a surface of the body of water;

B) remaining submerged in the body of water while attached to the submerged object for a predetermined period of time; and later C) being called upon from a remote location for freeing the signal buoy (1) from the submerged object;

the method characterized by steps of:

a) selecting to form a signal buoy line (3) from a line having cross section (5-5) exceeding six to one;

b) causing release of the signal buoy from a location that is submerged in a body of water (13) thereby also causing pay out of the signal buoy line (3);

c) retrieving the released signal buoy and the payed-out signal buoy line (3); and d) re-packing the signal buoy line (3) into a stack (4) of layers (8), and retaining the stack of layers with the signal buoy.

10. The method of claim 9 further characterized by steps of selecting to re-pack the signal buoy line (3) into the stacking (4) of layers (8) within a cavity (9) formed in the signal buoy.

11. The method of claim 9 for repeated use of a signal buoy (1) having a signal buoy line (3), the method further characterized by steps of, after step (b) of claim 9, and prior to step (d) of claim 9:

i) retrieving the released signal buoy and the payed-out signal buoy line (3);

ii) winding the signal buoy line (3) upon a winch;

iii) transferring the signal buoy line (3) from the winch over to a transport reel; and iv) unwinding the signal buoy line (3) from the transport reel.

* * * * *